United States Patent [19]

Schneller

[11] Patent Number: 4,624,087

[45] Date of Patent: Nov. 25, 1986

[54] DRYWALL EXTERIOR CORNER BEAD

[75] Inventor: Joseph W. Schneller, Williamsville, N.Y.

[73] Assignee: National Gypsum Company, Dallas, Tex.

[21] Appl. No.: 675,624

[22] Filed: Nov. 28, 1984

[51] Int. Cl.[4] ..... E04B 1/00

[52] U.S. Cl. ..... 52/254; 52/288; 52/464; 52/716

[58] Field of Search ..... 52/254–256, 52/312, 287, 288, 716, 464, 466, 468

[56] References Cited

U.S. PATENT DOCUMENTS

| | | | |
|---|---|---|---|
| 1,615,972 | 2/1927 | Bowers | 52/255 |
| 2,047,747 | 7/1936 | Schemmel | 52/716 |
| 2,663,390 | 12/1953 | Dordel | 52/211 |
| 2,779,983 | 2/1957 | Sundelin | 52/716 |
| 2,843,889 | 7/1958 | Keller | 52/312 |
| 2,851,741 | 9/1958 | Stemples | 52/255 |
| 3,471,982 | 10/1969 | Strozewski | 52/468 |
| 4,127,974 | 12/1978 | Wendt | 52/716 |
| 4,339,898 | 7/1982 | Pichette | 52/716 |

FOREIGN PATENT DOCUMENTS

| | | | |
|---|---|---|---|
| 561172 | 7/1958 | Canada | 52/254 |

*Primary Examiner*—John E. Murtagh
*Assistant Examiner*—Andrew Joseph Rudy
*Attorney, Agent, or Firm*—Robert F. Hause

[57] ABSTRACT

A formed sheet metal corner bead having a channel portion for mounting on the edge of one sheet of wallboard and a narrow double layer flange extending laterally outward to cover the edge of a second sheet of wallboard which forms an exterior corner with the first sheet of wallboard.

10 Claims, 2 Drawing Figures

DRYWALL EXTERIOR CORNER BEAD

This invention relates to an exterior corner bead for providing a finished exterior corner on drywall construction, and to provide protection for the relatively frangible gypsum wallboard edges at a drywall exterior corner.

BACKGROUND OF THE INVENTION

Exterior corners of drywall construction are presently constructed, most commonly, with an exterior metal corner bead having a pair of narrow flanges each diverging from a central semicircular small hollow bead, as shown in U.S. Pat. No. 2,851,741. The two flanges extend at an angle of about 90° to one another, and are adhered or nailed in place over the wallboard edges. The flanges are then covered with a cementitious material, such as a joint compound, using the metal bead as a screed, and feathering out the opposite edge of the joint compound, to form a coat substantially coplanar with the wallboard surface, concealing the flanges, and terminating at the small raised bead at the corner.

To avoid a shrunken and cracked coating of the cementitious material, when it dries and hardens, it is generally necessary to apply the cementitious material in two or three coats, allowing prior coats to harden and dry before a subsequent coat is applied.

SUMMARY OF THE INVENTION

The present invention consists of an elongate metal corner bead which provides a finished exterior corner over the edges of gypsum wallboard without the need for the application of any cementitious material thereover or even adjacent thereto. This elongate corner bead is formed and placed on the edge of a gypsum wallboard, at an exterior corner, in somewhat the same way as a casing bead is formed and placed on the edge of a gypsum wallboard at the periphery of a wall adjacent a doorway or a window. The main difference in the present invention, as compared to a casing bead, is in the addition of a flange, formed by a fold in the sheet metal, which extends outwardly over the edge of a second sheet of gypsum wallboard.

It is an object of the present invention to provide an improved drywall exterior corner bead.

It is a further object to provide an improved drywall exterior corner structure, permitting substantial savings in its construction.

DESCRIPTION OF THE PREFERRED EMBODIMENT

Figure 1:
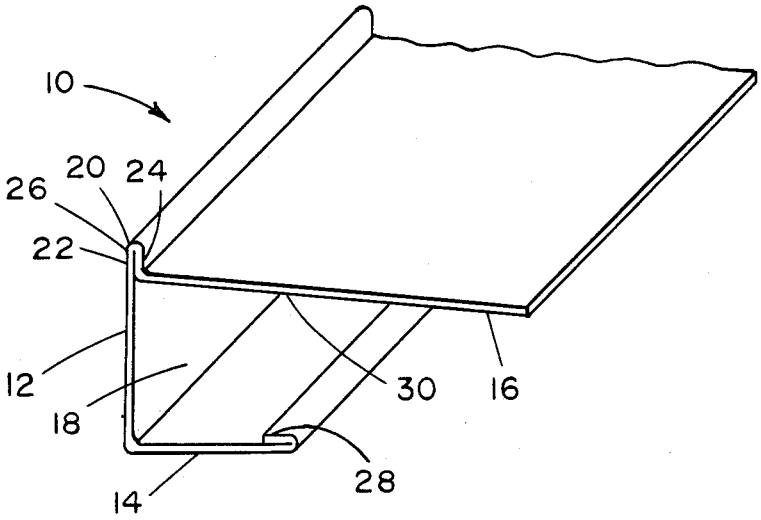
FIG. 1 is an isometric view of a short portion of drywall exterior corner bead, embodying the invention.

Referring to FIG. 1, there is shown a galvanized steel, 0.014 inch thick, sheet metal drywall corner bead 10, consisting of an elongate flat end web 12, a short flange 14 extending at a right angle from one edge of end web 12, and a flat long flange 16 approximately 5° from parallel to short flange 14, forming between the flanges a channel 18.

Long flange 16 is adjoined to end web 12 by a narrow, double layer flange 20, including an outer layer 22 which is a narrow edge portion of the flat end web 12 and a parallel inner layer 24, which connects the outer edge 26 of end web 12 with the long flange 16.

Short flange 14 terminates at its outer edge in a double layer hem 28 consisting of a narrow strip of sheet metal folded back on itself.

In order to create the type of stresses in corner bead 10 when in use, as described herebelow, the long flange 16 is formed so that it extends at an angle of about 85° to end web 12, and thus about 5° from parallel to short flange 14. The space between hem 28 and the long flange 16 at a point 30 across from hem 28 is slightly less than the thickness of the wallboard on which it is to be used. The space between short flange 14 and long flange 16 near the end web 12 is slightly greater than the thickness of the wallboard on which it is to be used. For example, for ½ inch wallboard, the narrower opening should be about 0.490 inch and the width of the channel 18 near the end web 12 should be about 0.530 inch. The widths of end web 12 and short flange 14 are preferably about ⅝ inch to ¾ inch, in a corner bead 10 for ½ inch wallboard, however the short flange 14 might preferably be narrower for economy reasons.

Figure 2:
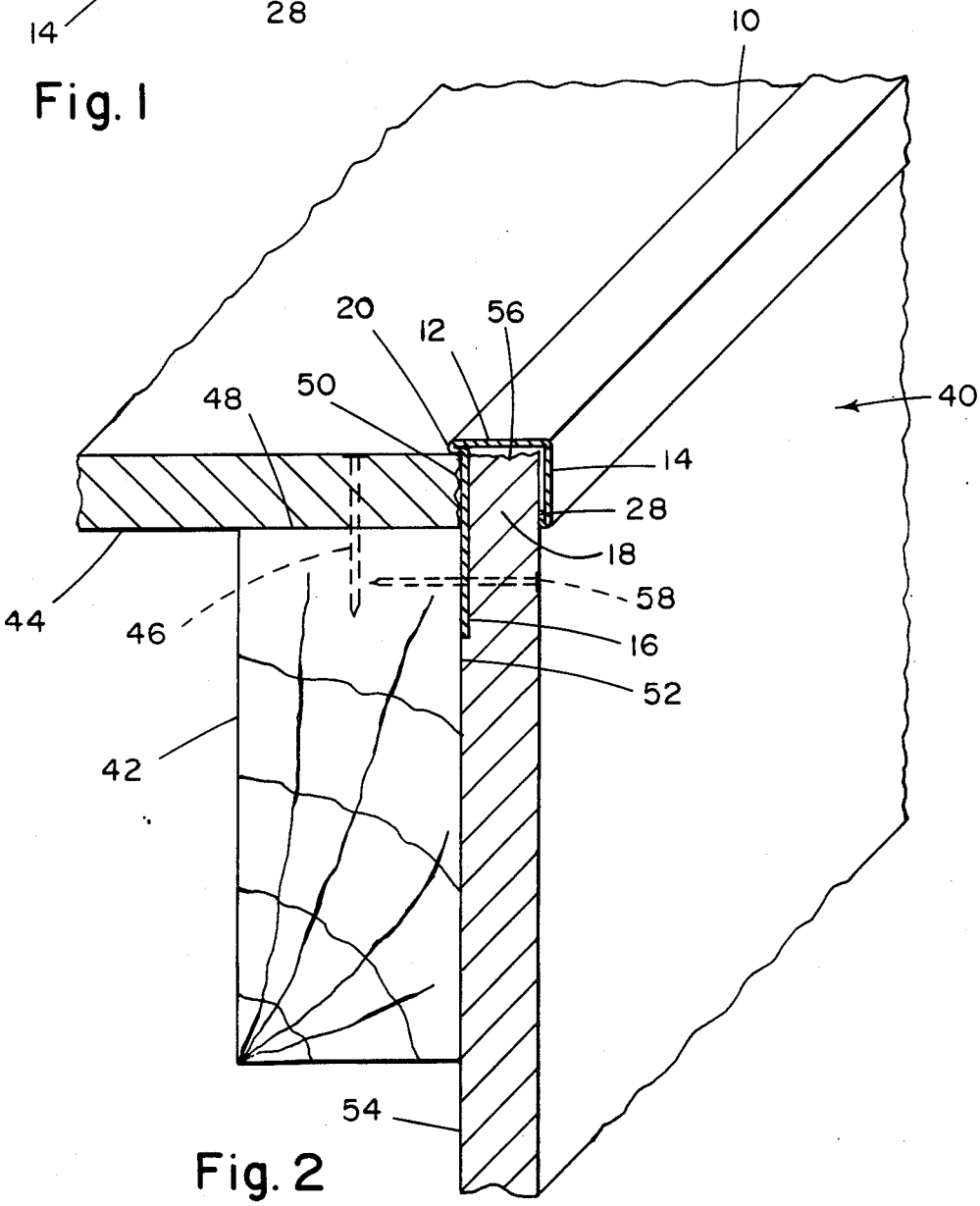
FIG. 2 is an isometric view of an exterior corner, of drywall construction, including a corner bead as shown in FIG. 1.

Referring to FIG. 2, there is shown an exterior corner 40, of interior drywall construction, such as where a closet extends into a room or when a hallway includes a 90° turn. A wood 2×4 stud 42 has a first gypsum wallboard 44 affixed by nails 46 to side 48 of stud 42 with the wallboard edge 50 substantially flush with the side 52 of stud 42. A second gypsum wallboard 54 is affixed by similar nails 58 to the side 52 of stud 42 with its edge 56 disposed within a corner bead 10 extending beyond side 48 of stud 42, and overlapping the edge 50 of first wallboard 44.

In constructing corner 40, the first wallboard 44 is nailed to side 48 of stud 42. Corner bead 10 is placed on edge 56 of wallboard 54. Channel 18 of corner bead 10 is slighter wider at its innermost end than the thickness of wallboard 54, and although channel 18 is narrower than the thickness of wallboard 54 adjacent hem 28, insertion of the wallboard edge 56 into channel 18 is reasonably quick and easy, by bending the short flange 14 and the long flange 16 slightly apart.

Corner bead 10 is not forced completely on to wallboard edge 56, leaving some space for adjustment as the wallboard and corner bead are being finally affixed in a final disposition. Second wallboard 54, with the corner bead in place on the edge 56, is then placed against stud 42 and other adjacent studs (not shown). With the corner bead 10, on edge 56, disposed so that double layer flange 20 overlaps edge 50 of first wallboard 44, the second wallboard 54 is affixed in place, as by at least two nails into adjacent studs.

The wallboard edge 56 and the corner bead 10 thereon are then simultaneously affixed to stud 42, by nails 58, which extend through a portion of wallboard near short flange 14 but not covered by short flange 14. Nails 58 extend through wallboard edge 56, through long flange 16 and into stud 42. As these nails are being driven in, the portion of corner bead thereat is held so that the double layer flange 20 is disposed firmly against first wallboard edge 50.

The heads of nails 46 and 58 are slightly countersunk into the surface of wallboards 44 and 54 and a thin coat of an aqueous joint compound slurry are applied over the nail beads to hide them, in accordance with common drywall practice.

By reason of the 5° difference between the angular relation of the short flange and the long flange to the end web, the hem 28 on the edge of the short flange is always firmly urged against the edge 56 of second wallboard 54.

Having completed a detailed disclosure of the preferred embodiment of my invention, so that others may practice the same, I contemplate that variations may be made without departing from the essence of the invention.

I claim:

1. A drywall exterior corner structure comprising an elongate framing member having a cross-section including two substantially perpendicular wallboard contacting sides, a first wallboard affixed to one of said sides and a second wallboard affixed to the other said perpendicular side, said second wallboard having mounted thereon a preformed elongate corner bead, said corner bead having an elongate flat end web, an elongate short flange extending at substantially a right angle from one edge of said end web, and an elongate flat long flange extending at an angle of about 85° from the main portion of said end web and approximately 5° from parallel to and spaced from said short flange and forming a channel therebetween within which is disposed said second wallboard, said flat long flange and said flat end web being adjoined in such manner that a narrow edge portion of said flat end web has a width sufficient for concealing, and disposed whereat it conceals, the edge of said first wallboard, whereby said first wallboard and said second wallboard form an exterior corner concealed and protected by said corner bead.

2. A drywall exterior corner structure as defined in claim 1 wherein said long flange extends at an angle of less than 90° to said end web, whereby said channel has a width at said end web which is greater than the width at the outer edge of said short flange.

3. A drywall exterior corner structure as defined in claim 1 wherein said end web has a width substantially equal to the width of said short flange.

4. A drywall exterior corner structure as defined in claim 1 wherein said corner bead short flange is under a stress urging the outer edge of said short flange firmly against said second wallboard.

5. A drywall exterior corner structure as defined in claim 1 wherein said end web and said short flange are disposed in substantially perpendicular relation to one another covering the edges of said first and second wallboards with said narrow edge portion and said short flange outer edge each urged firmly against a respective wallboard outer face.

6. A drywall exterior corner structure comprising an elongate framing member having a rectangular cross section, a first wallboard affixed to one face of said framing member and a second wallboard affixed to a perpendicular face of said framing member, said second wallboard having mounted thereon a formed sheet metal corner bead comprising an elongate flat end web, an elongate short flange extending at substantially a right angle from one edge of said end web, and an elongate flat long flange extending at an angle of about 85° from the main portion of said end web and approximately 5° from parallel to said short flange and forming a channel therebetween, said flat long flange and said flat end web being adjoined by a narrow, double layer flange which includes an outer layer which is a narrow edge portion of said flat end web and a parallel inner layer which connects the outer edge of said end web with said long flange, said channel having a width sufficient for receiving an edge of a sheet of gypsum wallboard and said double layer flange having a width sufficient for concealing the edge of an adjacent sheet of wallboard forming an exterior corner with said first sheet of wallboard, with said second wallboard having an edge extending into said corner bead channel, said corner bead long flange being disposed between said second wallboard and said framing member and said corner bead double layer flange being disposed over the edge of said first wallboard and concealing said first wallboard edge.

7. A drywall exterior corner structure as defined in claim 6 wherein said short flange terminates at its outer edge in a double layer, inwardly folded hem, said hem being disposed against the outer exposed face of said second wallboard.

8. A drywall exterior corner structure as defined in claim 7 wherein said corner bead short flange is under a stress urging said hem firmly against said second wallboard.

9. A drywall corner structure as defined in claim 6 wherein said end web has a width substantially equal to the width of said short flange.

10. A drywall corner structure as defined in claim 9 wherein said end web and said short flange are disposed in perpendicular relation to one another covering the edges of said first and second wallboards with said double layer flange and said hem at the opposed edges thereof each urged firmly against a respective wallboard outer face.

* * * * *